US005183981A

United States Patent [19]

Thangavelu

[11] Patent Number: 5,183,981

[45] Date of Patent: Feb. 2, 1993

[54] "UP-PEAK"0 ELEVATOR CHANNELING SYSTEM WITH OPTIMIZED PREFERENTIAL SERVICE TO HIGH INTENSITY TRAFFIC FLOORS

[75] Inventor: Kandasamy Thangavelu, Avon, Conn.

[73] Assignee: Otis Elevator Company, Farmington, Conn.

[21] Appl. No.: 487,344

[22] Filed: Mar. 2, 1990

Related U.S. Application Data

[63] Continuation-in-part of Ser. No. 318,295, Mar. 3, 1989, which is a continuation-in-part of Ser. No. 209,744, Jun. 21, 1988, Pat. No. 4,838,384.

[51] Int. Cl.[5] ..... B66B 1/20

[52] U.S. Cl. ..... 187/128; 187/125

[58] Field of Search ..... 187/127, 125, 131, 128; 377/6

[56] References Cited

U.S. PATENT DOCUMENTS

| | | | |
|---|---|---|---|
| 3,561,571 | 2/1971 | Gingrich | 187/127 |
| 4,303,851 | 12/1981 | Mottier | 377/6 |
| 4,305,479 | 12/1981 | Bitter et al. | 187/125 |
| 4,323,142 | 4/1982 | Bitter | 187/125 |
| 4,330,836 | 5/1982 | Donofrio et al. | 187/131 |
| 4,363,381 | 12/1982 | Bittar | 187/127 |
| 4,691,808 | 9/1987 | Nowak et al. | 187/125 |
| 4,792,019 | 12/1988 | Bittar et al. | 187/125 |
| 4,838,384 | 6/1989 | Thangavelu | 187/125 |
| 4,846,311 | 7/1989 | Thangauelu | 187/128 |

FOREIGN PATENT DOCUMENTS 255218 2/1961 Australia .

OTHER PUBLICATIONS

Forecasting Methods and Applications, Spyros Makridakis & S. C. Wheelwright (John Wiley & Sons, Inc., 1978), Section 3.3: "Single Exponential Smoothing" & Section 3.6: Linear Exponential Smoothing.

*Primary Examiner*—A. D. Pellinen
*Assistant Examiner*—S. Jackson
*Attorney, Agent, or Firm*—Breffni X. Baggot

[57] ABSTRACT

The present invention is directed to the grouping of contiguous floors in a building into sectors. According to the present invention, historical information regarding the number of passengers arriving at each floor is obtained and used to predict the number of passengers to be arriving at each of the floors. By summing the predicted traffic per floor and dividing by the number of sectors to be formed, average traffic per sector can be determined. In the preferred embodiment, sectors are formed, starting from the first floor above the lobby and continuing through to the top floor in the building, by selecting a set of contiguous floors for each sector such that the predicted traffic for each sector is less than a predetermined threshold. Specifically, if the predicted traffic for a selectable next contiguous floor, added to the predicted traffic for all contiguous floors already selected for the sector, is less than the predetermined threshold, the selectable floor is included in the sector. Otherwise, another sector is begun with the selectable floor as the bottom floor in the other sector. In the preferred embodiment, the predetermined threshold is based on the determined average traffic per sector. In another aspect of the present invention, the frequency of service of elevator cars to each sector is variable. The traffic volume for each formed sector is determined and compared with the determined average traffic per sector. The frequency of service of elevator cars to each sector is variable, based on this comparison. Thus, sectors having a larger traffic volume are serviced more often, relative to sectors having a smaller traffic volume.

8 Claims, 7 Drawing Sheets

MACHINE ROOM "MR"
MAIN FLOOR (LOBBY) "L"
SN=3
SN=2
SN=1
13
9
8
6
5
2
FROM 40
GROUP CONTROL
CPU
PL
32
POS...CC
POS...CC
DRIVE & MOTION CONTROL
CPU
30
HC
LW
SI
CC
U
D
12
14
16
18
1
2
3
4
2-5
6-8
9-13

"UP-PEAK"0 ELEVATOR CHANNELING SYSTEM WITH OPTIMIZED PREFERENTIAL SERVICE TO HIGH INTENSITY TRAFFIC FLOORS

REFERENCE TO RELATED APPLICATIONS

This application is a continuation-in-part of co-pending application Ser. No. 07/318,295 filed Mar. 3, 1989 entitled "'Artificial Intelligence' Based Crowd Sensing System For Elevator Car Assignment," which incorporated by reference its companion application Ser. No. 07/318,307 of Kandasamy Thangavelu, the inventor hereof, entitled "Relative System Response Elevator Dispatcher System Using 'Artificial Intelligence' to Vary Bonuses and Penalties," likewise filed on Mar. 3, 1989, which '295 application is in turn a continuation-in-part of Ser. No. 07/209,744 entitled "Queue Based Elevator Dispatching System Using Peak Period Traffic Prediction" filed Jun. 21, 1988, now U.S. Pat. No. 4,838,384 issued Jun. 13, 1989, which incorporated by reference the disclosure of its companion application entitled "Optimized 'Up-Peak' Elevator Channeling System With Predicted Traffic Volume Equalized Sector Assignments" of Kandasamy Thangavelu, the inventor hereof, likewise filed Jun. 21, 1988, now U.S. Pat. No. 4,846,311 issued Jul. 11, 1989, the disclosures of which are all incorporated herein by reference.

This application also relates to some of the same subject matter as the co-pending, concurrently filed application listed below, owned by the assignee hereof, the disclosure of which is also incorporated herein by reference:

Ser. No. 487,574 of the inventor hereof entitled "'Artificial Intelligence' Based Learning System Predicting 'Peak-Period' Times For Elevator Dispatching" filed on even date herewith.

TECHNICAL FIELD

The present invention relates to the dispatching of elevator cars in an elevator system containing a plurality of cars providing group service to a plurality of floors in a building during "up-peak" conditions, and more particularly to a computer based system for optimizing the "up-peak" channeling for such a multi-car, multi-floor elevator system using "up-peak" traffic predictors on a floor by floor basis.

BACKGROUND ART

General Introduction

In a building having a group of elevators, elevator inter-floor traffic and traffic from a main floor (e.g. the lobby) to upper floors varies throughout the day. Traffic demand from the main lobby is manifested by the floor destinations entered by passengers (car calls) on the car call buttons.

Traffic from the lobby is usually highest in the morning in an office building. This is known as the "up-peak" period, the time of day when passengers entering the building at the lobby mostly go to certain floors and when there is little, if any, "inter-floor" traffic (i.e. few hall calls). Within the up-peak period, traffic demand from the lobby may be time related. Groups of workers for the same business occupying adjacent floors may have the same starting time but be different from other workers in the building. A large influx of workers may congregate in the lobby awaiting elevator service to a few adjacent or contiguous floors. Some time later a new influx of people will enter the lobby to go to different floors.

During an up-peak period elevator cars that are at the lobby frequently do not have adequate capacity to handle the traffic volume (the number of car calls) to the floors to which they will travel. Some other cars may depart the lobby with less than their maximum (full) loads. Under these conditions car availability, capacity and destinations are not efficiently matched to the immediate needs of the passengers. The time it takes for a car to return to the lobby and pick up more passengers (passenger waiting time) expands, when these loading disparities are present.

In the vast majority of group control elevator systems in use, waiting time expansion is traceable to the condition that the elevator cars respond to car calls from the lobby without regard to the actual number of passengers in the lobby that intend to go to the destination floor. Two cars can serve the same floor, separated only by some dispatching interval (the time allowed to elapse before a car is dispatched). Dispatching this way does not minimize the waiting time in the lobby, because the car load factor (the ratio of actual car load to its maximum load) is not maximized, and the number of stops made before the car returns to the lobby to receive more passengers is not minimized.

In some existing systems, for instance U.S. Pat. No. 4,305,479 to Bittar et al entitled "Variable Elevator 'Up' Peak Dispatching Interval" (issued Dec. 15, 1981), assigned to Otis Elevator Company, the dispatching interval from the lobby is regulated. Sometimes this means that a car, in a temporary dormant condition, may have to wait for other cars to be dispatched from the lobby before receiving passengers who then enter car calls for the car.

To increase the passenger handling capacity per unit of time, the number of stops that a car can make may be limited to certain floors. Cars, often arranged in banks, may form a small group of cars that together serve only certain floors. A passenger enters any one of the cars and is permitted to enter a car call (by pressing a button on the car operating panel) only to the floors served by the group of cars. "Grouping," as this is commonly called, increases car loading, improving system efficiency, but does not minimize the round trip time back to the lobby. The main reason is that it does not force the car to service a floor with the minimum number of stops before reaching that floor.

In some elevator systems cars are assigned floors based on car calls that are entered from a central location. U.S. Pat. No. 4,691,808 to Nowak et al entitled "Adaptive Assignment of Elevator Car Calls" (issued Sep. 8, 1987), assigned to Otis Elevator Company, describes a system in which that takes place, as does Australian Patent 255,218 granted in 1961 to Leo Port. This approach directs the passengers to cars.

General Approach of Invention

The present invention is directed to optimizing a still further approach, namely, channeling, in which the floors above the main floor or lobby are grouped into sectors, with each sector consisting of a set of contiguous floors and with each sector assigned to a car, with such an approach being used during up-peak conditions.

During up-peak elevator operation, such channeling has been used to reduce the average number of car stops per trip and the highest reversal floor. This has reduced the round trip time and has increased the number of car trips made, for example, during each five (5) minute period.

By this approach, to some degree, the maximum waiting time and service times have been reduced, and the elevator handling capacity has been increased. It has thus been possible to some degree to handle up-peak traffic using fewer and/or smaller cars for a particular building situation. However, the prior attempts to use such channeling to equalize the number of passengers handled by each sector has been done by selecting equal numbers of floors for each sector, which generally assumes that the traffic flow with time on a floor by floor basis is equal, which is not accurate for many building situations.

In contrast, rather than merely assigning an equal number of floors per sector, the invention of U.S. Pat. No. 4,846,311 entitled "Optimized 'Up-Peak' Elevator Channeling System With Predicted Traffic Volume Equalized Sector Assignments" (issued Jul. 11, 1989) of Kandasamy Thangavelu, the inventor hereof, the disclosure of which is incorporated herein by reference, establishes a method of and system for predicting the future deboarding traffic levels of the various floors for, for example, each five (5) minute interval, using historic and real time data. It uses this predicted traffic to more intelligently assign the floors to more appropriately configured sectors, having possibly varying numbers of floors, or even over-lapping floors, to optimize the effects of up-peak channeling.

In the invention of the '311 patent sectors are formed such that each sector serves equal traffic volume. Since the channeling process assigns cars to the sectors cyclically in a round robin fashion, by having each sector serve an equal traffic volume, the average queue length and the waiting time at the lobby are reduced.

However, the practical implementation of the above scheme showed that often one floor is included in two or more sectors. When one floor is in two sectors, often two cars at the lobby show the same floor assignment. Initially, this causes confusion to the people. But soon, the users learn that the sector that has this common floor as the starting floor provides non-stop service to that floor, thus reducing the service time. So all people, who have not yet boarded the car that serves the other sector that also includes this floor assignment, tend to use the higher sector. This delays the dispatch of the car on the lower sector, thus increasing the waiting time to the passengers served by that sector, and the load on the higher sector increases. Often people going to the floors above this common floor experience additional waiting time. The problem is further compounded when one floor has large traffic volume and hence is in more than two sectors.

The current invention eliminates the need for one floor to be in more than one sector, as allowed in the exemplary embodiment of the '311 patent. The present invention is based on the principle that the service can be further improved by not requiring all sectors to serve equal traffic volume and by varying the frequency of car assignment to the sectors as a function of the traffic volume served.

The present invention utilizes two different approaches to define the sectors for up-peak channeling, using predicted traffic data such that each high traffic volume floor, that is, a floor with high intensity traffic, is in one sector only. The methodology to select appropriate frequency of service to various traffic sectors including high traffic sectors and low traffic sectors is also described. This methodology decreases service time by decreasing the average waiting time, as well as the trip time, to the passengers and is an improvement over the exemplary embodiment of the '311 patent.

It is noted that some of the general prediction or forecasting techniques utilized in the present invention are discussed in general (but not in any elevator context or in any context analogous thereto) in *Forecasting Methods and Applications* by Spyros Makridakis and Steven C. Wheelwright (John Wiley & Sons, Inc., 1978), particularly in Section 3.3: "Single Exponential Smoothing" and Section 3.6: "Linear Exponential Smoothing."

DISCLOSURE OF INVENTION

The present invention originated from the need to include one floor in only one sector when sectors are formed using predicted traffic for up-peak channeling, so passenger confusion and performance degradation can be avoided.

An analysis done as part of the invention indicates that, by grouping floors into sectors and appropriately selecting sectors, and, when each sector does not handle equal traffic volume during varying traffic conditions, by selecting different frequency of service for different sectors (thus varying the time interval between successive assignments of cars for a sector) the queue length and waiting time at the lobby can be decreased even more, and the handling capacity of the elevator system even further increased.

The present invention pertains to the methodology developed to achieve these advantageous objectives.

The current invention first establishes an effective method of and system for estimating the future traffic flow levels of various floors for, for example, each five (5) minute interval, for enhanced channeling and enhanced system performance.

This estimation can be made using traffic levels measured during the past few time intervals on the given day, namely as "real time" predictors, and, when available, traffic levels measured during similar time intervals on previous days, namely "historic" predictors. The estimated traffic is then used to intelligently group floors into sectors, so that the variation in sector traffic volumes is minimal for each given five (5) minute period or interval, while each floor is assigned to only one sector.

Thus, by changing the sector configuration with, for example, each five (5) minute interval, and by assigning one floor to one sector and by varying the frequency of service of each sector as a function of traffic volume handled, the time variation of traffic levels of various floors is appropriately served.

When the frequency of service is varied as a function of sector traffic volume, the queue length and waiting time are reduced at the lobby. All cars thus are caused to carry a more nearly equal traffic volume, and thus the system has a higher handling capacity.

The invention's use of "today's" traffic data to predict future traffic levels provides for a quick response to the current day's traffic variations. Additionally, the preferred use of linear exponential smoothing in the real time prediction and of single exponential smoothing in the historic prediction, and the combining of both of them with varying multiplication factors to produce optimized traffic predictions also significantly enhance the efficiency and effectiveness of the system.

The invention may be practiced in a wide variety of elevator systems, utilizing known technology, in the light of the teachings of the invention, which are discussed in detail hereafter.

Other features and advantages will be apparent from the specification and claims and from the accompanying drawings, which illustrate an exemplary embodiment of the invention.

BEST MODE FOR CARRYING OUT THE INVENTION

Exemplary Elevator Application

Figure 1:
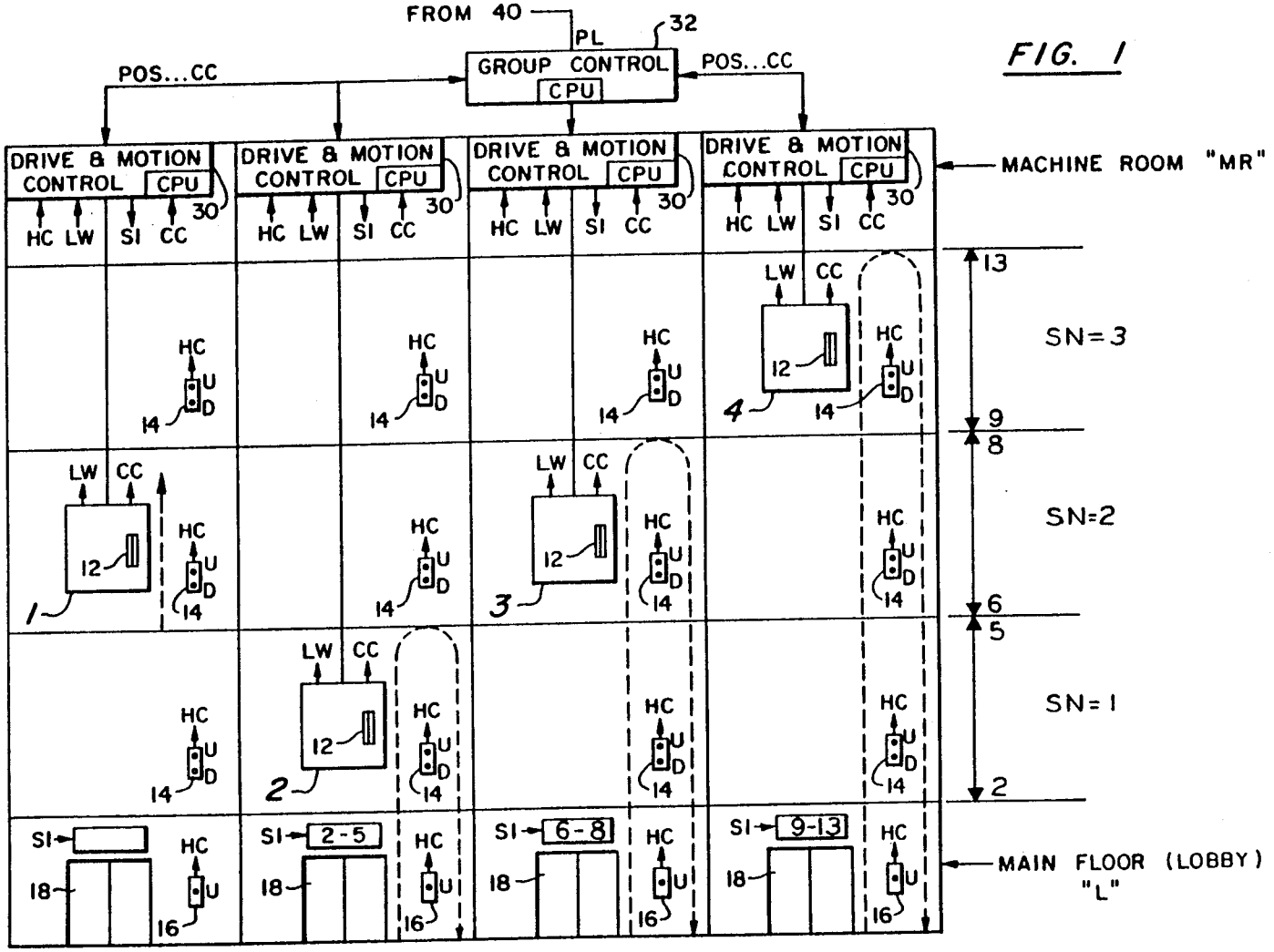
FIG. 1 is a functional block diagram of an exemplary elevator system, including an exemplary four car "group" serving an exemplary thirteen floors.

An exemplary multi-car, multi-floor elevator application or environment, with which the exemplary dispatcher of the present invention can be used, is illustrated in FIG. 1.

In FIG. 1 an exemplary four elevator cars 1-4, which are part of a group elevator system, serve a building having a plurality of floors. For the exemplary purpose of this specification, the building has an exemplary twelve (12) floors above a main floor, typically a ground floor lobby "L". However, some buildings have their main floor at the top of the building, in some unusual terrain situations, or in some intermediate portion of the building, and the invention can be analogously adapted to them as well.

Each car 1-4 contains a car operating panel 12, through which a passenger may make a car call to a floor by pressing a button, producing a signal "CC", identifying the floor to which the passenger intends to travel. On each of the floors there is a hall fixture 14, through which a hall call signal "HC" is provided to indicate the intended direction of travel by a passenger on the floor. At the lobby "L" there is also a hall call fixture 16, through which a passenger calls the car to the lobby.

Figure 3:
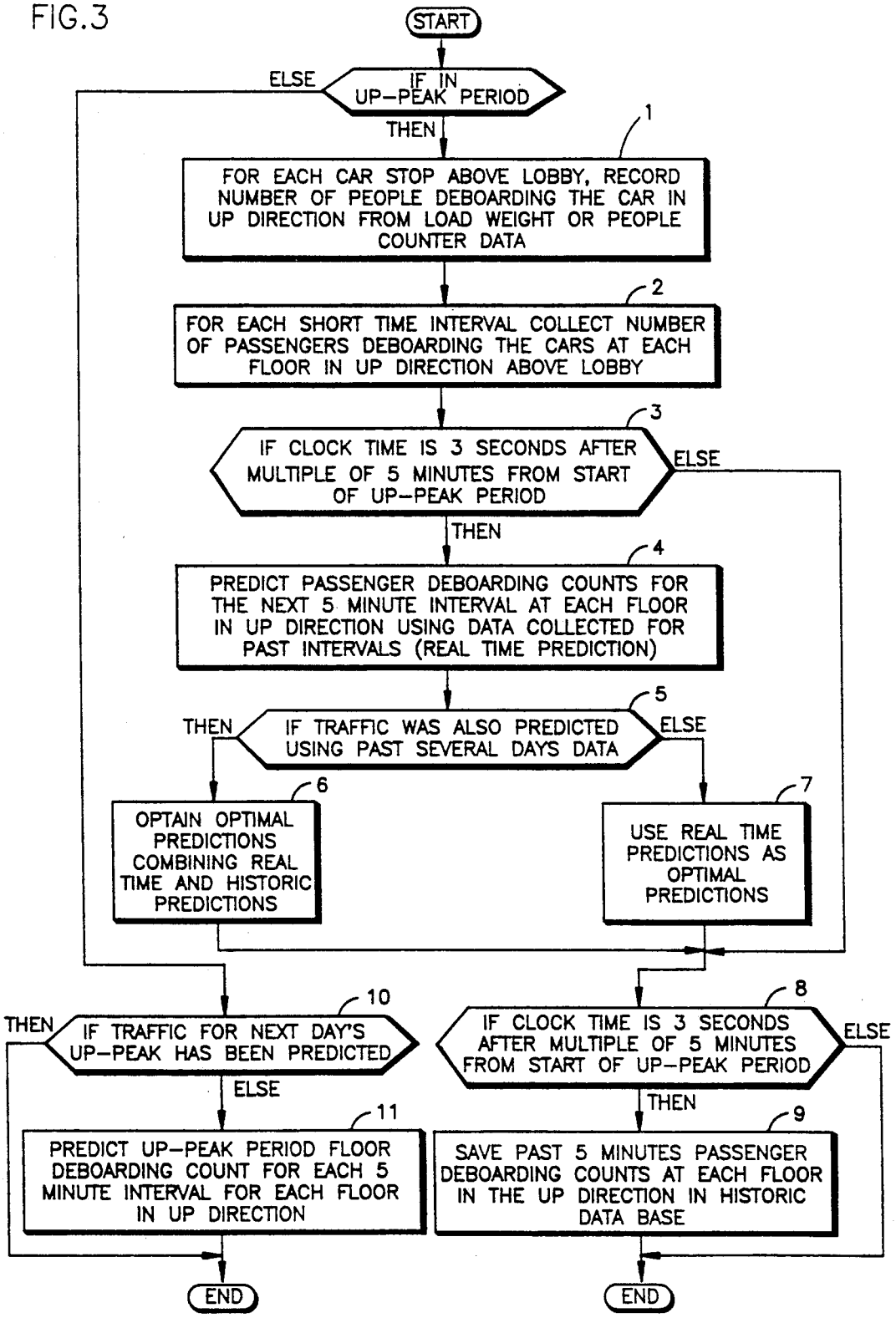
FIG. 3 is a logic flow chart diagram of software blocks illustrating the up-peak period floor traffic estimation methodology part of the dispatching routine used in the exemplary embodiment of the present invention; it being noted that FIGS. 1-3 hereof are substantively identical to the same figures of '311 patent, with the exception of the respective exemplary sector floor assignments in FIG. 1.

The depiction of the group in FIG. 1 is intended to illustrate the selection of cars during an up-peak period, according to the invention, at which time the exemplary floors 2-13 above the main floor or lobby "L" are divided into an appropriate number of sectors, depending upon the number of cars in operation and the traffic volume, with each sector containing a number of contiguous floors assigned in accordance with the criteria and operation used in the present invention, all as explained more fully below in the context of the flow charts of FIGS. 3-5.

If desired, only three of the cars 1-4 may be assigned, one to each of three sectors, leaving one car free. However, alternatively, the floors of the building may be divided into four sectors, in which case all four of the cars can be used to individually serve, for example, four sectors.

At the lobby and located above each door 18, there is a service indicator "SI" for each car, which shows the temporary, current selection of available floors exclusively reachable from the lobby by its respective car based on the sector assigned to that car. That assignment changes throughout the up-peak period, as explained below, and for distinguishing purposes each sector is given a number "SN" and each car is given a number "CN".

For exemplary purposes for a particular floor-sector-car assignment, it is assumed that for a particular day the up-peak deboarding conditions of the system, when the algorithms or routines of FIGS. 3-5 are processed, will cause the following car sector floor assignments to be made. For example, assuming that car 1 is to be allowed to be unassigned to a sector, in the case of car 2 (CN=2), it is assigned to serve the first sector (SN=1). Car 3 (CN=3) will serve the second sector (SN=2), while car 4 (CN=4) serves the third sector (SN=3). As noted, car 1 (CN=1) is momentarily not assigned to a sector.

The service indicator "SI" for car 2 will display, for example, floors 2-5, the presumed floors assigned to the first sector for this example, to which floors that car will exclusively provide service from the lobby—but possibly for one trip from the lobby. Car 3 similarly provides exclusive service to the second sector, consisting of the floors assigned to that sector, for example floors 6-8, and the indicator for car 3 will show those floors. The indicator for car 4 indicates for example floors 9-13, the floors assigned to the third sector under the presumed conditions.

Thus, as can be seen from this example, the sectors can have different numbers of floors assigned to them (in the example four upper floors for SN=1, three upper floors for SN=2, and five upper floors for SN=3).

The service indicator for the car 1 is not illuminated, showing that it is not serving any restricted sector at this particular instant of time during the up-peak channeling sequence reflected in FIG. 1. Car 1, however, may have a sector assigned to it as it approached the lobby at a subsequent time, depending on the position of the other cars at that time and the current assignment of sectors to cars and the desired parameters of the system.

Each car 1-4 will only respond to car calls that are made in the car from the lobby to floors that coincide with the floors in the sector assigned to that car. The car 4, for instance, in the exemplary assignments above, will only respond to car calls made at the lobby to floors 9-13. It will take passengers from the lobby to those floors (provided car calls are made to those floors) and then return to the lobby empty, unless it is assigned to a hall call.

Such a hall call assignment may be done using the sequences described in U.S. Pat. No. 4,792,019 of Joseph Bittar and Kandasamy Thangavelu, the latter being the inventor hereof, entitled "Contiguous Floor Channeling With 'Up' Hall Call Elevator Dispatching" (issued Dec. 20, 1988).

As has been noted, the mode of dispatching of the present invention is used during an up-peak period. At other times of the ay, when typically there is more "inter-floor" traffic, different dispatching routines may be used to satisfy inter-floor traffic and traffic to the lobby (it tends to build after the up-peak period, which occurs at the beginning of the work day). For example, the dispatching routines described in the below identified U.S. patents, all assigned to Otis Elevator Company, including the "Bittar patents":

U.S. Pat. NO. 4,363,381 to Bittar on "Relative System Response Elevator Call Assignments" (issued Dec. 3, 1979), and/or U.S. Pat. No. 4,323,142 to Bittar et al on "Dynamically Reevaluated Elevator Call Assignments" (issued Dec. 3, 1979);

as well as the "Tangavelu patents";

U.S. Pat. No. 4,838,384 entitled "Queue Based Elevator Dispatching System Using Peak Period Traffic Prediction" and applications Ser. No. 07/318,307 entitled "Relative System Response Elevator Dispatcher System Using 'Artificial Intelligence' to Vary Bonuses and Penalties" and Ser. No. 07/318,295 entitled "'Artificial Intelligence' Based Crowd Sensing System For Elevator Car Assignment,"

may be used at other times in whole or in part in an overall dispatching system, in which the routines associated with the invention are accessed during the up-peak condition.

As in other elevator systems, each car 1–4 is connected to a drive and motion control 30, typically located in the machine room "MR". Each of these motion control 30 is connected to a group control or controller 32. Although it is not shown, each car's position in the building would be served by the controller through a position indicator as shown in the previous Bittar patents.

The controls 30, 32 contain a "CPU" (central processing unit) or signal processor for processing data from the system. The group controller 32, using signals from the drive and motion controls 30, selects the sectors that will be served by each of the cars in accordance with the operations discussed below.

Each motion control 30 receives the "HC" and "CC" signals and provides a drive signal to the service indicator "SI". Each motion control also receives data from the car that it controls on the car load "LW". It also measures the elapsed time while the doors are open at the lobby (the "dwell time," as it is commonly called).

The drive and motion controls are shown in a very simplified manner herein because numerous patents and technical publications showing details of drive and motion controls for elevators are available for further detail.

The "CPUs" in the controllers 30, 32 are programmable to carry out the routines described herein to effect the dispatching operations of this invention at a certain time of day or under selected building conditions, and it is also assumed that at other times the controllers are capable of resorting to different dispatching routines, for instance, the routines shown in the aforementioned Bittar and Thangavelu patents or the other cited patents and applications.

Owing to the computing capability of the "CPUs", this system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and floor traffic may also be analyzed through signals "LW," from each car, each signal indicating the respective car's load.

Actual lobby traffic may also be sensed by using a people sensor (not shown) in the lobby. U.S. Pat. No. 4,330,836 to Donofrio et al on an "Elevator Cab Load Measuring System" (issued May 18, 1982) and U.S. Pat. No. 4,303,851 to Mottier on a "People and Object Counting System" (issued Dec. 1, 1981), both assigned to Otis Elevator Company, show approaches that may be employed to generate these signals. Using such data and correlating it with the time of ay and the day of the week and the actual entry of car calls and hall calls, a meaningful demand demograph can be obtained for allocating floors to the sectors and selecting frequency of car assignment to the sectors, throughout the up-peak period in accordance with the invention by using signal processing routines that implement the sequences described in the flow charts of FIGS. 4 and 5, described more fully below, in order to minimize the queue length and waiting time at the lobby.

In discussing the dispatching of the elevator cars to sectors using the assignment scheme or logic illustrated in FIGS. 3, 4 and 5, it is assumed (for convenience) that the elevator cars 1–4 are moving throughout the building, eventually returning to the "lobby" (the main floor serving the upper floors) to pick up passengers.

Exemplary Dispatching System of Invention

As noted above, the present invention originated from the need to further improve service during an up-peak period when up-peak channeling is used.

The current invention eliminates the need for one floor to be in more than one sector, as used in the exemplary embodiment of the '311 patent. The present invention is based on the principle that the service can be further improved by not requiring all sectors to serve equal traffic volume, if the frequency of car assignment to the sectors can be varied as a function of the traffic volume served. Such a strategy provides high frequency service to sectors handling more than average traffic volume, resulting in reduced waiting time for a large number of people. For sectors serving much less than the average sector volume, a minimum frequency will be guaranteed, to limit their maximum waiting time to pre-specified limits.

This methodology decreases the queue length and waiting time at the lobby "L." It decreases service time by decreasing the average waiting time as well as the trip time to the passengers. It also increases the handling capacity of the system and is an improvement over the embodiment of the '311 patent. The methodology developed to achieve these objectives will be described in connection with FIGS. 2–5.

Figure 2:
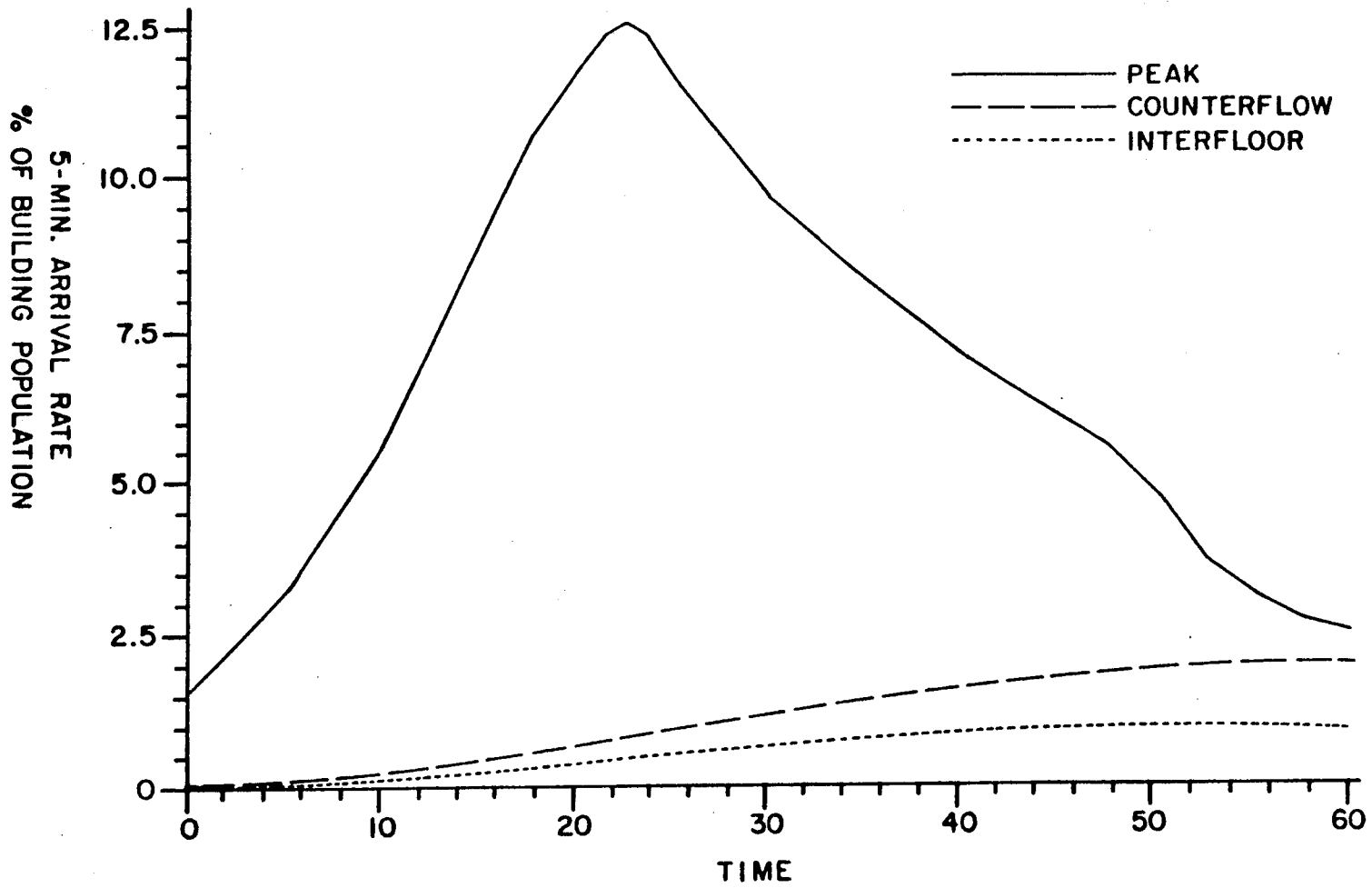
FIG. 2 is a graphical illustration showing the up-peak period traffic variation in a graph of an exemplary five (5) minute arrival rate percent of building population vs. time, graphing the peak, counterflow and inter-floor values.

FIG. 2 shows an exemplary variation of traffic during the up-peak period at the lobby, graphing the peak, the counterflow and the inter-floor figures. Above the lobby "L" the traffic reaches its maximum value at different times at different floors, depending on the office starting hours and the use of the floors. Thus, as may be seen, while traffic to some floors is rapidly increasing, the traffic to other floors may be steady or increasing slowly or even decreasing.

FIG. 3

FIG. 3 illustrates in flow chart form the exemplary methodology used in the exemplary embodiment of the present invention to collect and predict passenger traffic at each floor for, for example, each five (5) minute interval during the up-peak period.

In summary, as can be abstracted from the logic flow chart and the foregoing, during up-peak periods, the deboarding counts are collected for short time intervals at each floor above the lobby. The data collected "today" is used to predict deboarding counts during, for example, the next few minutes for, for example, a five (5) minute interval, at each floor using preferably a linear exponential smoothing model or other suitable forecasting model. For a further understanding of this linear exponential smoothing model, reference is had to the Makridakis/Wheelwright treatise, particularly Section 3.6.

The traffic is also predicted of forecast during off-peak periods, for, for example, each five (5) minute up-peak interval, using data collected during the past several days for such interval and using the "single exponential smoothing" model. For a further understanding of this model, reference again is had to the Makridakis/Wheelwright treatise, particularly Section 3.3.

When this historic prediction is available, it is preferably combined with real time prediction to arrive at the optimal predictions or forecasts using the relationship:

$$X = ax_h + bx_r$$

where "X" is the combined prediction, "$x_h$" is the historic prediction and "$x_r$" is the real time prediction for the five (5) minute interval for the floor, and "a" and "b" are multiplication factors, whose summation is unity ($a+b=1$). The relative values of these multiplication factors preferably are selected as described in the '311 patent, causing the two types of predictors to be relatively weighted in favor of one or the other, or given equal weight if the "constants" are equal, as desired.

The relative values for "a" and "b" can be determined as follows. When the up-peak period starts, the initial predictions preferably assume that $a=b=0.5$. The predictions are made at the end of each minute, using the past several minutes data for the real time prediction and the historic prediction data.

The predicted data for, for example, six minutes is compared against the actual observations at those minutes. If at least, for example, four observations are either positive or negative and the error is more than, for example, twenty (20%) percent of the combined predictions, then the values of "a" and "b" are adjusted. This adjustment is made using a "look-up" table generated, for example, based on past experience and experimentation in such situations. The look-up table provides relative values, so that, when the error is large, the real time predictions are given increasingly more weight.

These values would typically vary from building to building and may be "learned" by the system by experimenting with different values and comparing the resulting combined prediction against the actual, so that, for example, the sum of the square of the error is minimized. Thus, the prediction factors "a" and "b" are adaptively controlled or selected.

This combined prediction is made in real time and used in selecting the sectors for optimized up-peak channeling. The inclusion of real time prediction in the combined prediction and the use of linear exponential smoothing for real time prediction result in a rapid response to today's variation in traffic.

Of course, as is well known to those of ordinary skill in the art, the controller includes appropriate clock means and signal sensing and comparison means from which the time of day and the day of the week and the day of the year can be determined and which can determine the various time periods which are needed to perform the various algorithms of the present invention.

In greater detail and with particular reference to the logic steps of FIG. 3, at the start, if the system shows that the up-peak period is in effect, then in Step 1 the number of people deboarding the car for each car stop above the lobby "L" in the "up" direction is recorded using the changes in load weight "LW" or people counting data. Additionally, in Step 2, for each short time interval the number of passengers or people deboarding the cars at each floor in the "up" direction above the lobby is collected. Then, in Step 3, if the clock time is a few seconds (for example, three seconds) after a multiple of five (5) minutes from the start of the up-peak period, in Step 4 the passenger deboarding counts for the next five (5) minute interval are predicated at each floor in the "up" direction, using the data previously collected for the past intervals, producing a "real time" prediction ($x_r$). Else, if the clock time is not three seconds after a multiple of five (5) minutes from the start of the up-peak period, the algorithm proceeds directly to Step 8.

Continuing after Step 4 to Step 5, if the traffic was also predicted using the historic data of the past several days and hence an historic prediction ($x_h$) is available, then in Step 6, optimal predictions are obtained by directly combining the real time ($x_r$) and the historic ($x_h$) predictions, with the values of the "constants" equalized ($a=b=0.5$), or with the real time and the historic predictors relatively weighted, if so desired. Otherwise, if the historic data has not yet been generated, then in Step 7 only the real time predictions are used as the optimal predictions.

Finally, whether the results are obtained through Step 6 or Step 7 or, if back in Step 3 the clock time was not three (3) seconds after a multiple of five (5) minutes from the start of the up-peak period; in Step 8, if the clock time is a few seconds (for example, three seconds) after a multiple of five (5) minutes from the start of the up-peak period, then the passenger deboarding counts at each floor in the "up" direction for the past five (5) minutes is saved and stored in the "historic" data base, and the algorithm is ended. If in Step 8 the clock time is not three (3) seconds after a five (5) minute multiple from the start of the up-peak period, then the algorithm is immediately ended from Step 8.

On the other hand, if in the initial start of the algorithm the system indicated that the up-peak period was not present, then Step 10 is performed. In Step 10, if the traffic for the next day's up-peak has been predicted, then the algorithm is ended. If not, in Step 11 the floor deboarding counts for the up-peak period for each five (5) minute interval are predicted for each floor in the "up" direction, using the past several days' data and the exponential smoothing model, and the algorithm then ended.

After the algorithm or routine of FIG. 3 is ended, it is thereafter restarted and cyclically repeated.

Figure 4A:
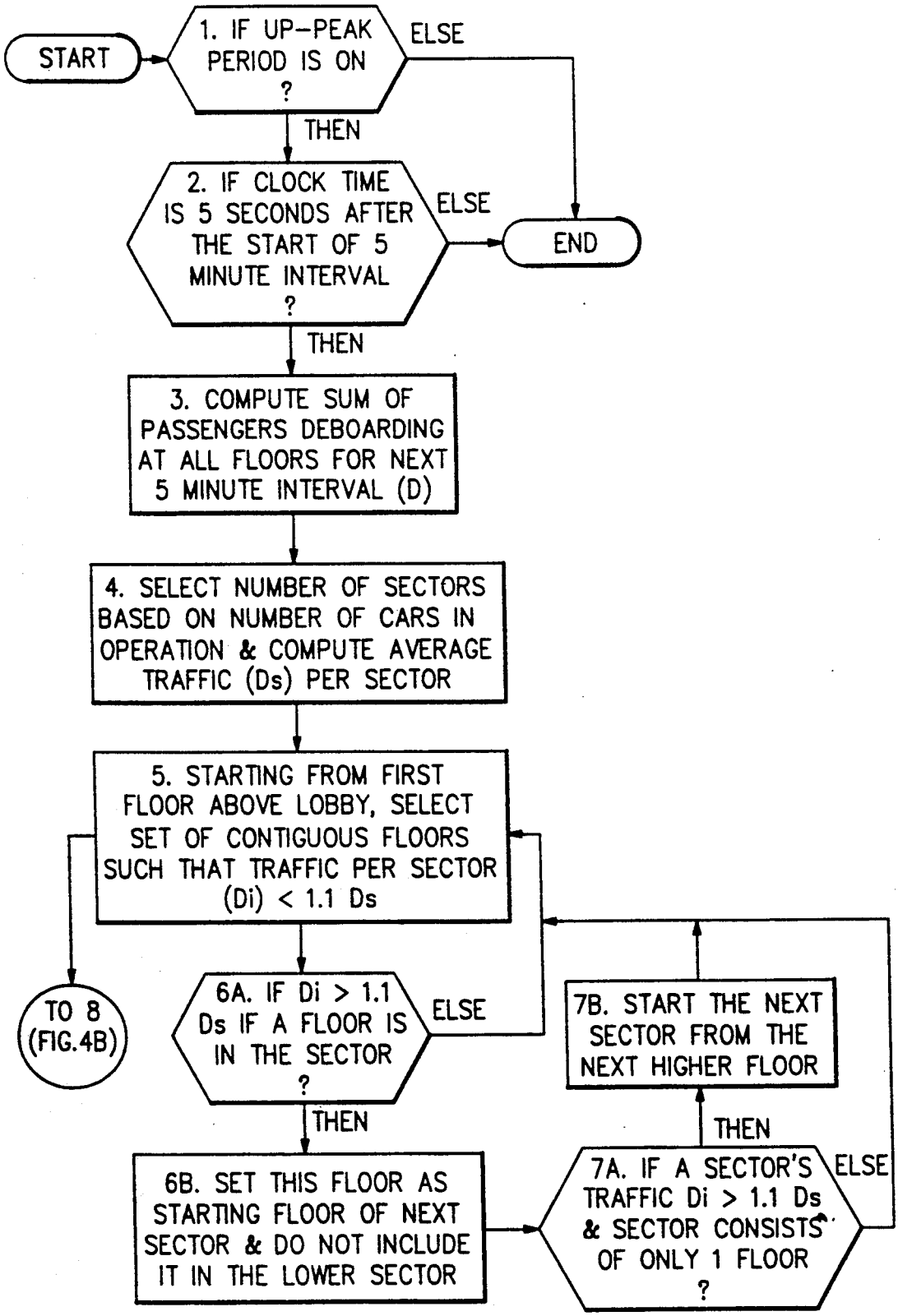
FIGS. 4A and 4B, in combination, is a logic flow chart diagram of software blocks illustrating the methodology used to modify the sector formation of the '311 patent, so that each floor is included in one sector only, as used in the exemplary embodiment of the present invention.
Figure 4B:
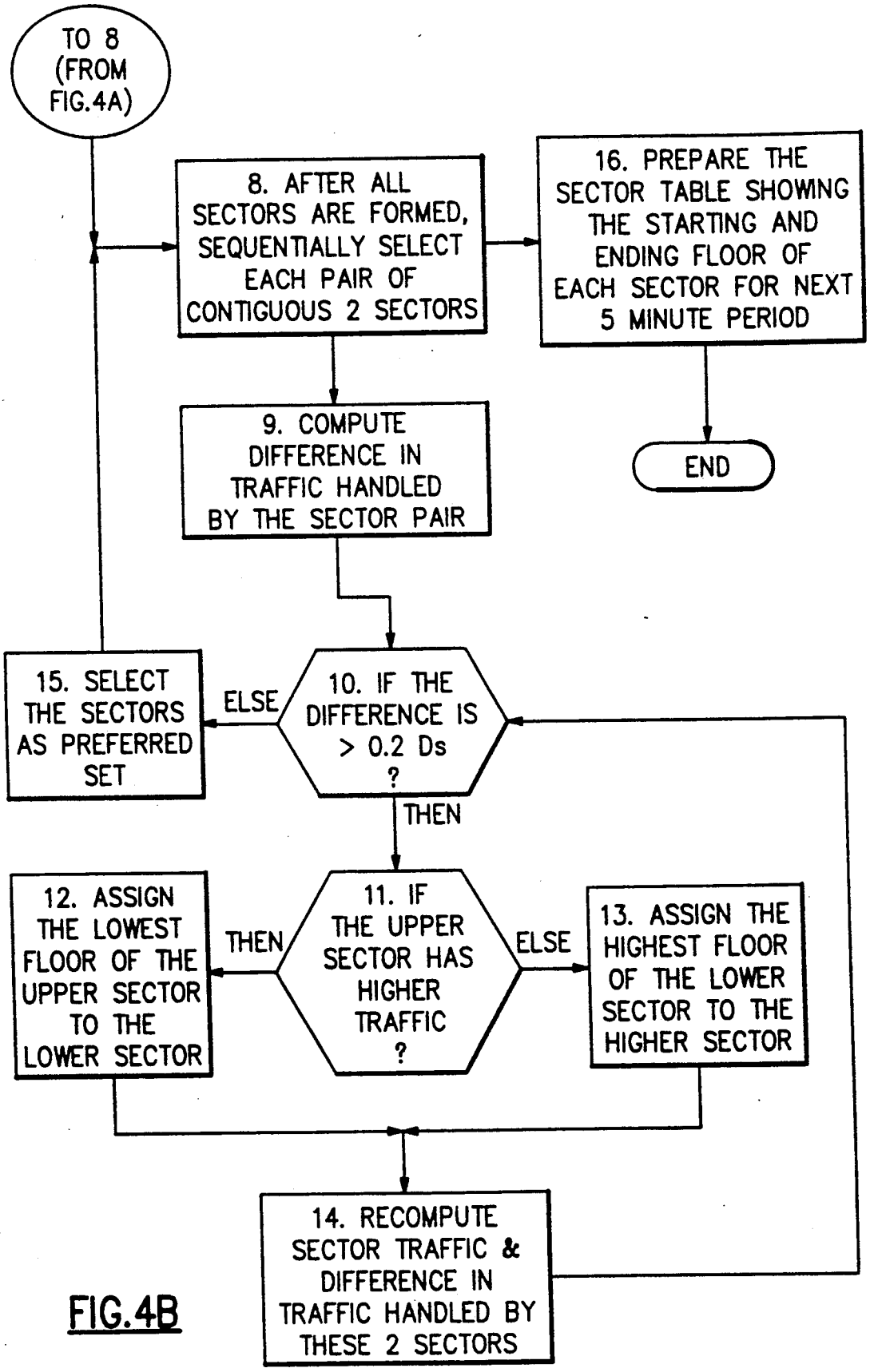

FIGS. 4A and 4B

FIGS. 4A and 4B, in combination, illustrates in flow chart form the logic used in the exemplary embodiment of the present invention for selecting the floors for forming sectors for each exemplary five (5) minute interval.

As illustrated, if in the initiating Step 1 an up-peak condition exists, then in Step 2, if it is only a few seconds [for example five (5) seconds] after the start of a five (5) minute interval, then in Step 3 the optimal predictions of the passenger deboarding counts at each floor above the lobby in the "up" direction are summed up, with the sum being considered equal to a variable "D".

In Step 4 the number of sectors to be used is then selected based on the total deboarding counts of all floors and the number of cars in operation, using, for example, previous simulation results and/or past experience. If "D" is large, usually a larger number of sectors is used. Similarly, if the number of cars is fewer than normal, the number of sectors may be reduced. By this approach the average traffic to be handled by each sector is computed and denoted by "$D_S$". Based on the exemplary elevator system illustrated in FIG. 1, the number of sectors might equal, for example, three (3).

Thus, the sectors ("SN") are formed such that each sector does not necessarily serve equal traffic volume. If "D" is the predicted total traffic volume for the next five (5) minute interval, and "N" is the number of cars in operation, then the average traffic per sector, $D_s=D/(N-1)$, assuming that one car, e.g. car 1, is not to be included in the sector assignments.

In Steps 5 to 14 the floors forming the sectors are then selected considering successive floors, starting from the first floor above the lobby "L", namely at the second floor. The following exemplary criteria is applied during this consideration in these steps.

In Step 5 the successive floors are included in the sector then under consideration, as long as the total traffic for that sector "$T_S$" is less than or equal to "$D_S$" plus some assigned additional amount allowed as a maximum deviation, for example, ten (10%) percent (namely, as long as $T_S \leqq 1.1D_S$). If "$T_S$" exceeds 1.1 "$D_S$," then the last floor is not included in that sector, and in Step 6 this last floor is used as the starting floor of the next sector.

If the floor has a large traffic volume so that it requires more than one sector, it is included in one sector only. The next sector starts from the floor above this high volume or high intensity traffic floor. (See Step 7)

After all the sectors ar formed, in Step 8 (see FIG. 4B) the sectors are taken in paris of two (2) starting from the lowest sector. In Step 9 the difference in traffic volumes of the two sectors is computed. If the difference is more than, for example, 0.2 $D_s$ (Step 10), then, if the lower sector has more traffic volume than the higher sector in Step 11's comparison, the highest floor of the lower sector is moved to the higher sector (Step 13), and the difference in traffic volume is again computed (Step 14). If this difference is lower than the previous computation, in Step 15 the new sectors are selected as the preferred set.

If the upper or higher sector has more traffic than the lower sector (Step 11), then the lowest floor of that sector is moved to the lower sector (Step 12) and again the difference in sector traffic computed (Step 14). If this is lower than the previous computation, the new sector configuration is preferred. The sector traffic is thus more or less equalized by considering pairs of sectors, (1,2), (2,3), (3,4), (4,5) etc.

Finally, in Step 16 the starting and ending floors of each sector are then saved in a table and the sector traffic ($D_i$) is noted. The table is used by the up-peak channeling logic of the group controller 32 to display the floors served by the cars, namely in the exemplary system of FIG. 1, the "SI" for each car 2–4 will display their assigned floors for their respective sectors. The algorithm or routine of FIGS. 4A and 4B will then end, to thereafter be restarted and cyclically sequentially repeated.

By changing the sector configuration with each five (5) minute interval, the time variation of traffic levels of various floors is appropriately served.

Figure 5A:
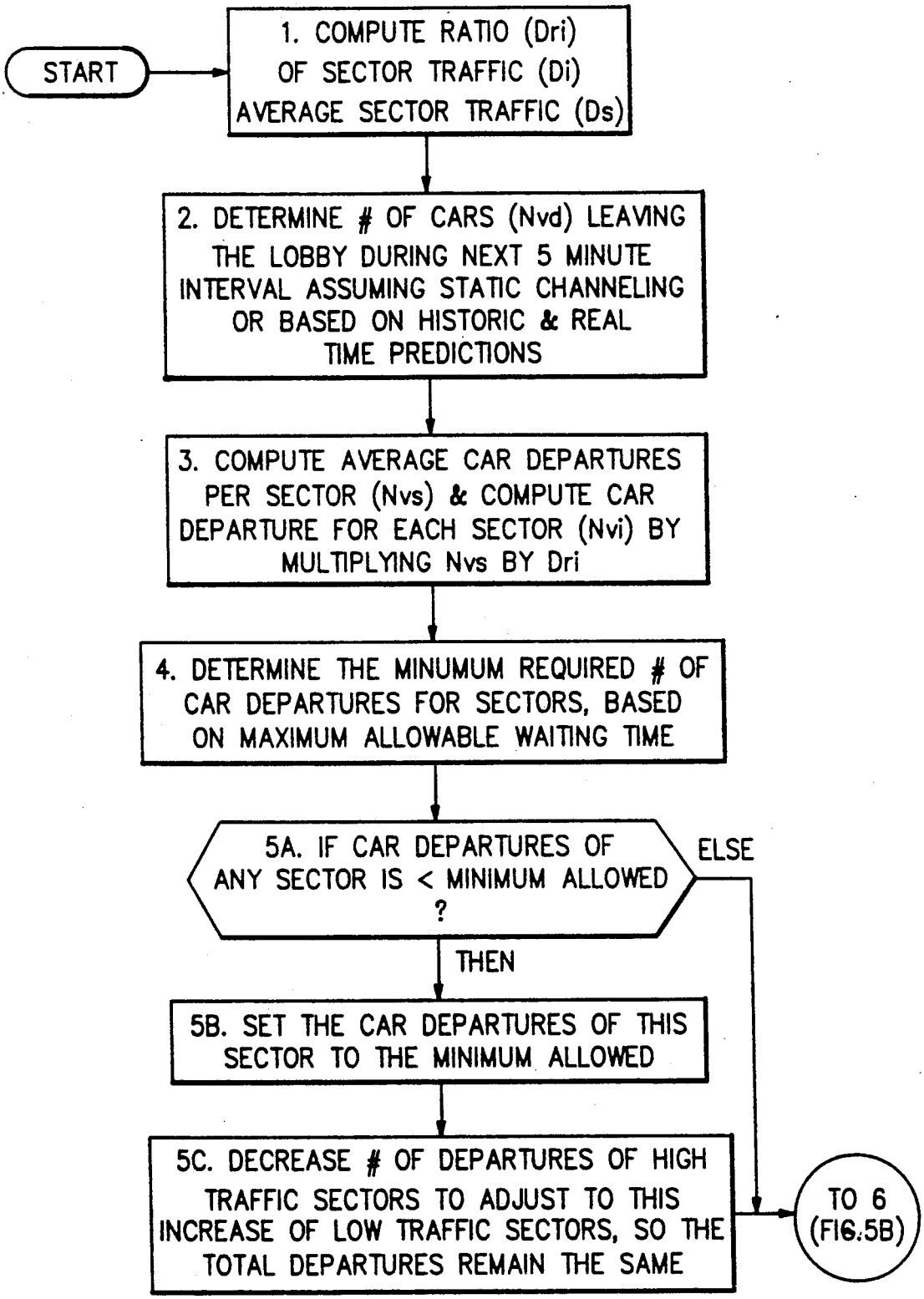
FIGS. 5A and 5B, in combination, is a logic flow chart diagram of software blocks illustrating the methodology used to assign cars to the sectors using variable frequency and variable interval assignment, as used in the exemplary embodiment of the present invention.
Figure 5B:
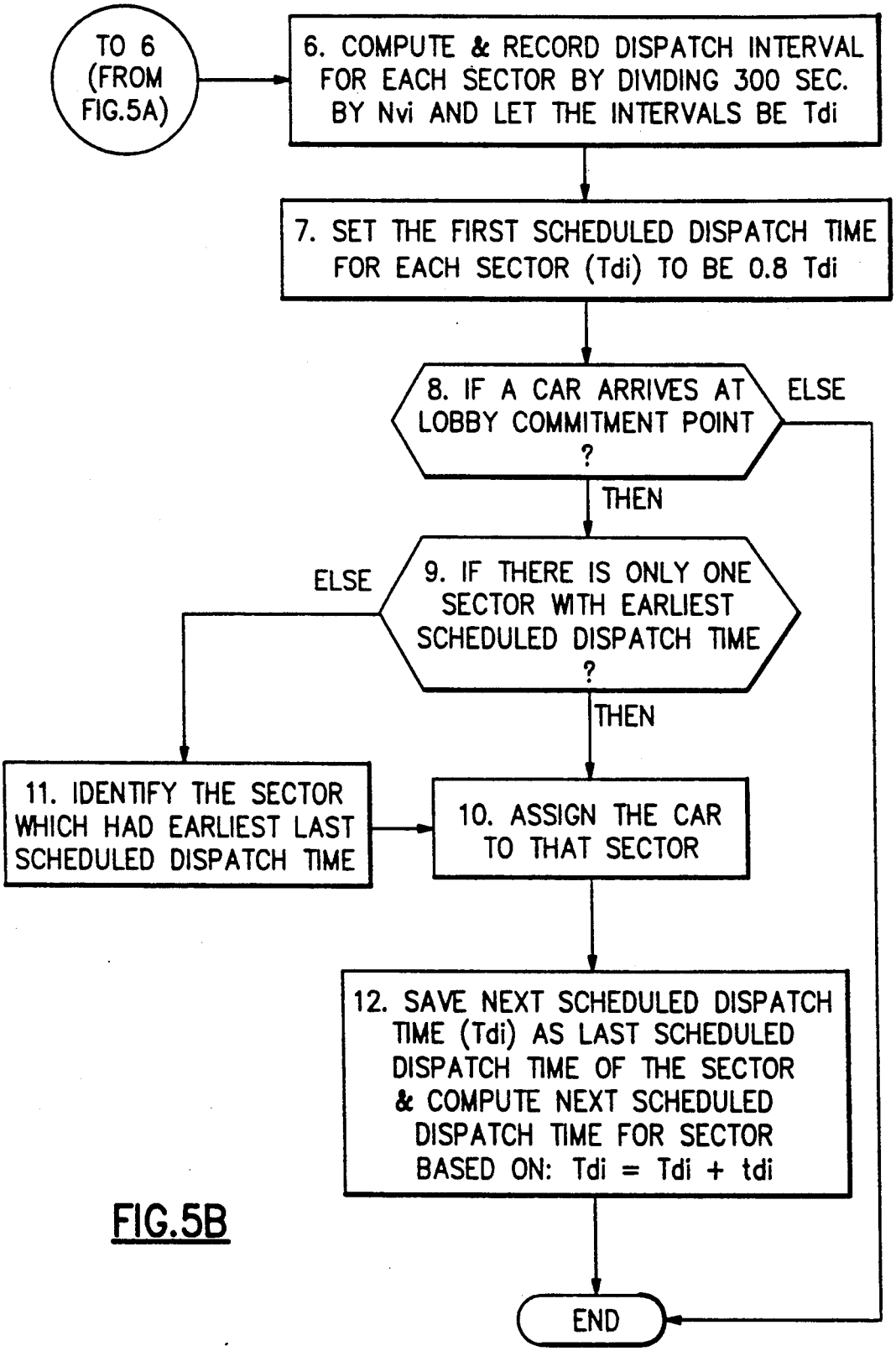

FIGS. 5A and 5B

FIGS. 5A and 5B, in combination, illustrates in flow chart form the logic used for assigning cars to the sectors using variable frequency and variable interval assignments.

Step 1: The ratio of sector traffic $D_1$ to the average traffic to be handled by each sector ($D_s$) is computed for each sector. This is denoted by $D_n$ for sector "i." Typical or exemplary values for an elevator group with four (4) cars, three (3) of which are assigned to sectors, are −0.82, 1.40 and 0.78.

Step 2: As noted above with respect to FIG. 3, the dispatching scheme, when first implemented, estimates the number of car departures from the lobby during the next five (5) minute interval, assuming that there is channeling without traffic prediction or channeling using traffic volume equalized sectors. To estimate the car departures, first the round trip time for each sector for the assumed stop schedule is computed. Then the average round trip time of all sectors is calculated. Then knowing the number of cars in operation, the estimates of car departures can be obtained. If up-peak channeling has been used in the past, the number of car departures can be predicted from the data collected on the past several days and the current data using historic and real time predictions. The estimated number of cars leaving the lobby during the five (5) minute interval is set to be $N_{Vd}$.

Step 3: Then, the average number of cars leaving per sector during the five (5) minute interval can be computed by $N_{Vd}/3$, where three (3) is the number of sectors selected. This is denoted by $N_{Vs}$. The number of cars that should depart on various sectors is computed by multiplying $N_{Vs}$ by $D_{ri}$. This is denoted as $N_{Vi}$.

Steps 4 and 5A-B: The maximum allowably waiting time is set to be $t_{wmax}$, which can be, for example, sixty (60) seconds. The maximum interval between cars ($t_{intm}$) on a sector is computed by adding, for example, fifteen (15) seconds to the maximum allowable waiting time, assuming that these cars stop at the lobby at least for more than fifteen (15) seconds. So the minimum allowable frequency is computed for the sectors, $N_{v\text{-}min}$. If $N_{Vi}$ on any sector is less than $N_{v\text{-}min}$, it is set to $N_{v\text{-}min}$. For each one car increase on any low traffic sector, the frequency of one of the high traffic sector with $N_{Vi} > N_{Vs}$ is decreased by one, so that the total of the car departures remains $N_{Vd}$.

Step 6: The dispatch interval ($t_{di}$) for various sectors is then computed by dividing the length of the five (5) minute interval [viz. three hundred (300) seconds] by the number of cars on the sector ($N_{Vi}$). These dispatch intervals are recorded in a table.

Step 7: At the start of the interval, the next scheduled dispatch time for the sector is set to, for example, 0.8 $t_{di}$. For example, if the dispatch intervals on the sectors are seventy-five (75), thirty-eight (38) and seventy-five (75) seconds, then the next dispatch time of the sectors ($T_{di}$) is set to sixty (60), thirty (30) and sixty (60) seconds, respectively.

Steps 8–10: Then, when a car arrives at the lobby commitment point from an upper floor, the car is assigned to the sector having the earliest scheduled dispatch time.

Step 11: If two or more sectors have the same scheduled dispatch time, the sector which had the earliest last scheduled dispatch time is first assigned the car.

Step 12: Then the car's next scheduled dispatch time ($T_{di}$) is moved to the last dispatch time ($T_{dii}$). The next scheduled dispatch time for the sector is then computed as:

$$T_{di} = T_{di} + t_{di}.$$

Thus, the next scheduled dispatch time table is continuously updated, and successively arriving cars are assigned to the sector having the earliest scheduled dispatch time.

This strategy or scheme thus provides high frequency service to sectors having high intensity traffic volume resulting in short waiting time(s) for a large number of people. At the same time, it limits the maximum waiting time on the low traffic sectors.

As previously mentioned, if variable frequency service is provided with non-uniform sector traffic, the queue length and waiting time are reduced at the lobby. All cars carry a more nearly equal traffic volume, and thus the system has a higher handling capacity.

Additionally, the use of today's traffic data to predict future traffic levels provides for a quick response to the current day's traffic variations.

A modification of the above scheme may be used to reduce the enroute stops for the floors having large traffic volume, so that the service time can be reduced for a large number of passengers. In this modified scheme, the floors attracting more than, for example, twice the average floor traffic volume is first identified. For example, in a building with fifteen (15) floors above the lobby [rather than the twelve (12) indicated in FIG. 1], the peak five (5) minute traffic volume might be, for example, one hundred and eighty (180) passengers. For such a situation, the average floor traffic volume would be twelve (180/15). Floors "4," "6," "9," "11" and "14" might have, for example, twenty-eight (28), twenty-two (22), twenty-three (23), twenty-six (26) and twenty-seven (27) passengers, respectively. The other floors would attract the remaining traffic.

Sectors are formed by first selecting these relatively "high traffic" floors as starting floors. The floors in between these high traffic floors are assigned to the sector below, and the highest floor of each sector is noted. The floors below the lowest sector are assigned to the lowest sector, unless the total traffic volume of all the floors below the lowest sector is more than, for example, 0.6 $D_s$, in which case it is formed into a separate sector. The floors above the highest sector are assigned to the highest sector.

The frequency of car dispatch on the sector is then calculated and adjusted as before. So the dispatch interval for the sector is computed and used to dispatch the cars on the sectors. By minimizing or eliminating the intermediate stops for heavy traffic floors, this modified scheme reduces the average service time for all passengers.

While the foregoing is a description of an exemplary best mode for carrying out the invention and also describes some exemplary variations and modifications that may be made to the invention in whole or in part, it should be understood by one skilled in the art that many other modifications and variations may be made to the apparatus, methodology and the programs described herein without departing from the true scope and spirit of the invention.

Having thus described at least one exemplary embodiment of the invention, that which is new and desired to be secured by Letters Patent is claimed below.

I claim:

1. In an elevator dispatching system controlling the assignment of elevator cars in a building having a lobby and a plurality of floors above the lobby, a method of grouping contiguous floors into sectors, said method comprising the steps of:

obtaining information on the number of passengers arriving at each floor above the lobby from elevator cars traveling in an UP-direction, said information covering at least a predetermined time interval;

predicting, for a subsequent predetermined time interval, the number of passengers to be arriving at each of the floors above the lobby from elevator cars traveling in the UP-direction based on said obtained information;

determining the number of sectors to be formed based on the number of elevator cars;

determining average traffic per sector based on said predicted passenger arrival count and said determined number of sectors; and starting from the first floor above the lobby and continuing through to the top floor in the building, selecting a set of contiguous floors for each sector such that the predicted traffic for each sector is less than a predetermined threshold, wherein if the predicted traffic for a selectable next contiguous floor, added to the predicted traffic for all contiguous floors already selected for the sector, is less than the predetermined threshold, include said selectable floor in the sector, otherwise, begin another sector with said selectable floor as the bottom floor in the other sector.

2. The method of claim 1, wherein said predetermined threshold is based on said determined average traffic per sector.

3. The method of claim 2, wherein said predetermined threshold is about 1.1* (said determined average traffic per sector).

4. The method of claim 1, said method further comprising the steps of:

determining predicted traffic of a lower and an upper, relative to the lobby, adjacent sector based on the predicted traffic of each floor in said sectors;

determining the difference in the predicted traffic of said lower and said upper adjacent sector; and, if said determined difference is greater than a predetermined amount, adjusting the configuration of said lower and upper adjacent sectors.

5. The method of claim 4, wherein said step of adjusting the configuration of said lower and upper adjacent sectors comprises the steps of:

comparing the predicted traffic of said lower sector with the predicted traffic of said upper sector; and if the predicted traffic of said lower sector is greater than the predicted traffic of said upper sector, reassigning the top floor of said lower sector as the bottom floor of said upper sector, provided said reassignment produces a lower difference in predicted traffic between said lower and said upper sectors than said determined difference.

6. The method of claim 4, wherein said step of adjusting the configuration of said lower and upper adjacent sectors comprises the steps of:

comparing the predicted traffic of said lower sector with the predicted traffic of said upper sector; and if the predicted traffic of said lower sector is less than the predicted traffic of said upper sector, reassigning the bottom floor of said upper sector as the top floor of said lower sector, provided said reassignment produces a lower difference in predicted traffic between said lower and said upper sectors than said determined difference.

7. In an elevator dispatching system controlling the assignment of elevator cars in a building having a lobby and a plurality of floors above the lobby, the floors above the lobby being grouped into predetermined sectors, a method of determining the frequency of service of elevator cars to each sector, said method comprising the steps of:

obtaining information on the number of passengers arriving at each floor above the lobby from elevator cars traveling in an UP-direction, said information covering at least a first predetermined time interval;

predicting, for a subsequent predetermined time interval, the number of passengers to be arriving at each of the floors above the lobby from elevator cars traveling in the UP-direction based on said obtained information;

determining traffic volume to each sector based on said predicted number of passengers to be arriving at each of the floors within each sector;

determining average traffic volume per sector based on said predicted number of passengers to be arriving at each of the floors and said determined number of sectors;

for each sector, comparing said determined traffic volume to each sector with said determined average traffic volume per sector; and determining the frequency of service of elevator cars to each sector based on said comparison.

8. The method of claim 7, wherein said step of determining the frequency of service to each sector comprises the steps of:

estimating number of elevator cars leaving the lobby during said first predetermined time interval;

determining average number of cars leaving the lobby per sector, based on said estimated number of elevator cars leaving the lobby and the number of sectors;

determining estimated number of cars leaving the lobby for each sector, based on said determined average number of cars leaving the lobby per sector and the ratio of said determined traffic volume to each sector with said determined average traffic volume per sector;

comparing said determined estimated number of cars leaving the lobby for each sector with a predetermined minimum value;

setting said determined estimated number of cars leaving the lobby for each sector to said predetermined minimum value if said determined estimated number of cars is less than said predetermined minimum value;

determining the dispatch interval for each sector based on the amount of time within a second predetermined time interval and said determined estimated number of cars leaving the lobby for each sector; and dispatching elevator cars to each of the sectors using a scheduling scheme which schedules the elevator cars to leave the lobby for each sector, based on said determined dispatch interval determined for the respective sectors.

* * * * *